United States Patent [19]

Lex

[11] 4,419,784

[45] Dec. 13, 1983

[54] PORTABLE BRUSH VACUUM CLEANER

[76] Inventor: Franz Lex, Annenstrasse 6, Graz, Austria

[21] Appl. No.: 271,091

[22] Filed: Jun. 5, 1981

[30] Foreign Application Priority Data

Jun. 10, 1980 [AT] Austria ..... 3040/80

[51] Int. Cl.[3] ..... A47L 5/26

[52] U.S. Cl. ..... 15/344; 15/347; 15/384

[58] Field of Search ..... 15/344, 384, 347, 350

[56] References Cited

U.S. PATENT DOCUMENTS 1,764,626 6/1930 Heckman ..... 15/384
4,204,298 5/1980 Handa et al. ..... 15/344

FOREIGN PATENT DOCUMENTS 1503729 2/1969 Fed. Rep. of Germany ..... 15/344
1532811 3/1970 Fed. Rep. of Germany ..... 15/344
2031696 12/1971 Fed. Rep. of Germany ..... 15/344
136450 7/1952 Sweden ..... 15/344

*Primary Examiner*—Chris K. Moore
*Attorney, Agent, or Firm*—Watson, Cole, Grindle & Watson

[57] ABSTRACT

A portable brush vacuum cleaner includes a casing enclosing an electric motor for a suction fan. The casing also encloses at least one roller cleaning brush driven by a speed reduction gear. A brush housing is connected to a dust collector provided above the roller brush. The brush housing is also connected with the suction side of the fan through a suction channel. In a divided space above the roller brush an additional suction chamber is provided which is partially formed by baffle elements. The additional suction chamber extends about the whole length of the brush or brushes and opens into the suction channel leading to the dust-collector.

9 Claims, 5 Drawing Figures

II
IV

PORTABLE BRUSH VACUUM CLEANER

BACKGROUND OF THE INVENTION

1. Field of the Invention

The invention relates generally to a portable brush vacuum cleaner and more particularly to a vacuum cleaner with a casing which houses an electric motor for a dust suction fan and for at least one roller-shaped cleaning brush driven by, for example, a speed reduction gear. This brush has a housing over it, and in this housing above the brush, and connected with the suction side of the fan, is a dust-collector, connected with a suction channel.

2. Description of the Prior Art

A cleaner generally directed to the subject of the present invention is described in German Patent DE-OS No. 1 503 729 which discloses an apparatus for cleaning shoes. This reference provides a casing in which a motor with a suction fan is mounted. The motor drives a roller-brush via simple spur gearing. Just above the brush is a hood covering about half of the brush intended to catch dust. The hood is provided with a filter element, the outlet of which is connected with the suction side of the fan. The object is to have the suction outlet opening into the suction channel which rises to the dust-collector lengthwise at about the center of the horizontal axis.

A disadvantage of the above noted construction is that, with a small suction opening, along the outer portions of the brush a satisfactory suction of the dust brushed out at a tangent to the brush is hardly possible. A further disadvantage is that loose objects such as shoe-laces and pieces of material can be sucked in through the opening formed between the brush and the casing. Such objects can wrap themselves around the brush and damage the appliance. Enlarging the suction hole, which might improve the suction performance, only facilitates the sucking in of loose objects, makes side access to objects to be cleaned a problem and also demands greater suction capacity.

SUMMARY OF THE INVENTION

Accordingly, an object of the invention is to develop a cleaning appliance which provides satisfactory suction along the outer reaches of the brush and which prevents the sucking of objects through the opening formed between the brush and the casing, while facilitating side access to objects to be cleaned.

This is achieved by the invention by providing a divided housing above the brush or brushes being provided with an additional suction space approximately as wide as the brush or brushes. This space opens out into the channel leading to the dust-collector. Thus, in contrast to the traditional arrangement, the dust brushed up initially goes into an additional suction space inside the brush housing above the brush or brushes, and only after this does the dust move into the suction channel of the dust-collector situated above the brush or brushes.

Without making access from the side more difficult, dust is sucked up along the whole length of the brush. The danger of loose objects being sucked in is eliminated by the invention by eliminating any intake slit in the housing around the lower end of the cleaning brush or brushes and by disposing the housing close to the outer edge of the brushes. By developing an extra suction channel the dispersal of the mixture of air and dust in different directions is made practical. It is preferable to make the cross-section of the intake the additional suction space above the brushes about the same size as the cross-section of the intake of the fan.

Another object of the invention is to connect the additional suction space above the brushes with at least one suction channel rising to and opening into the dust-collector. It is preferable to let the channel or channels emerge over the dust-filter and to provide the opening of the channel or channels with a flap valve to prevent unintentional emptying of the dust.

Another object of the invention is to connect the additional suction space above the brushes with at least one suction channel, adjacent to one of the faces of the dust-collector, preferably the front face. This is an advantage, because although the diameter of the dust-collector remains the same, a larger filter can be disposed therein or the dust collector can be formed so as to contain more dust. A further object of the invention is to locate the suction channel in a removable cover at the front of the dust-collector. Upon removal of the cover there is easy access to the suction channel and the dust-filter. Such removable cover can be fixed to the dust-collector with a screw, a bayonet joint or by hinged handles.

Yet another object of the invention is be to provide a cross-piece between two parallel cleaning brushes up to about the middle of the horizontal axis of the brushes so that each brush has its own separate suction space above it. These separate suction spaces could open out into one suction channel or into separate channels. The development of the brush housing with an additional covering element over the brush or brushes and with a cross-piece, which would give each brush its own sucction space, results in a better transfer of the dust brushed up from the suction space to the suction channel.

The brush housing can, as described above, be made in one piece with for example, the dust-collector and removably attached to the casing of the appliance with screws, clips or hinged handles. To enable replacement of the cleaning brush or brushes the brush or brushes should be taper bore mounted. The disadvantage of such construction is that at least the front portion of the housing will remain open and the air sucked in against the direction of the suction will have a negative influence on the suction of the dust from the suction space. With prior art appliances, effective vacuum cleaning and a good mounting of the brush or brushes is preferable to being able to replace the brushes.

Therefore, a further object of the invention, is to close the brush housing at both faces, or at least around the additional suction space, but preferably as far as the central axis of the brush or brushes, by facing walls, fitted with bearings for mounting the brush or brushes.

When the brush housing is divided and formed with the dust-collector and a removable housing portion which can be assembled with the brush housing and which is equipped with the additional suction space, it is an object of the invention to form the dust-collector in one piece with the casing of the appliance, which obviates any complicated fastening of the dust collector to the casing. This development is particularly practical because it makes possible the provision of a suction jet on the appliance instead of the brush housing. The suction jet only serves to provide suction, which enables the appliance to be used as a portable vacuum cleaner.

It is also possible to arrange the dust-collector and the brush housing separately from one another, such that the additional suction space is for example connected with the dust-collector by a suction channel on the front cover and the brush housing can be located on a fitting on the casing intended for this purpose.

It is possible for the brush housing on both front surfaces to be closed by facing walls which in each case extend from the upper edge of the additional suction space to below the brush axis. The facing walls are equipped with bearings for mounting the brush or brushes. In this way it is possible to replace the brush or brushes.

They also may be mounted at both ends.

Instead of the individual brushes, a housing element may be provided in which the brush or brushes are mounted via a slot, for instance, a guiding mounting groove provided on the dust-collector, such that the brush or brushes are provided with a half-shaft and are meshed with an input shaft for transmitting power after the housing element has been slotted into place. Cleaning or polishing brushes of various kinds can thus be fixed to the economical housing element and can then be stored for subsequent use.

The present invention enables the appliance to be made with two parallel brushes, the diameter of which can be kept small so that the dust-collector can be considerably enlarged in keeping with the motor-cover without detriment to the cleaning performance as compared with traditional arrangements. The flat filter, the only form possible in traditional arrangements, and the small capacity of the corresponding dust-filter necessitate frequent cleaning. This is a drawback. To eliminate this drawback, a further development of the invention enables the dust-collector connected with the additional suction space opening over the suction channel, to be made with a roller-filter. Compared with the flat filter. The roller filter has a far larger surface area and thus ensures effective vacuum cleaning even when the filter is not cleaned frequently. This filter may also be egg-shaped.

BRIEF DESCRIPTION OF THE DRAWINGS

Various other objects, features and attendant advantages of the present invention will be more fully appreciated as the same becomes better understood from the following detailed description when considered in connection with the accompanying drawings wherein.

DETAILED DESCRIPTION OF THE PREFERRED EMBODIMENT

Figures 1, 2, 3, 4, 5:
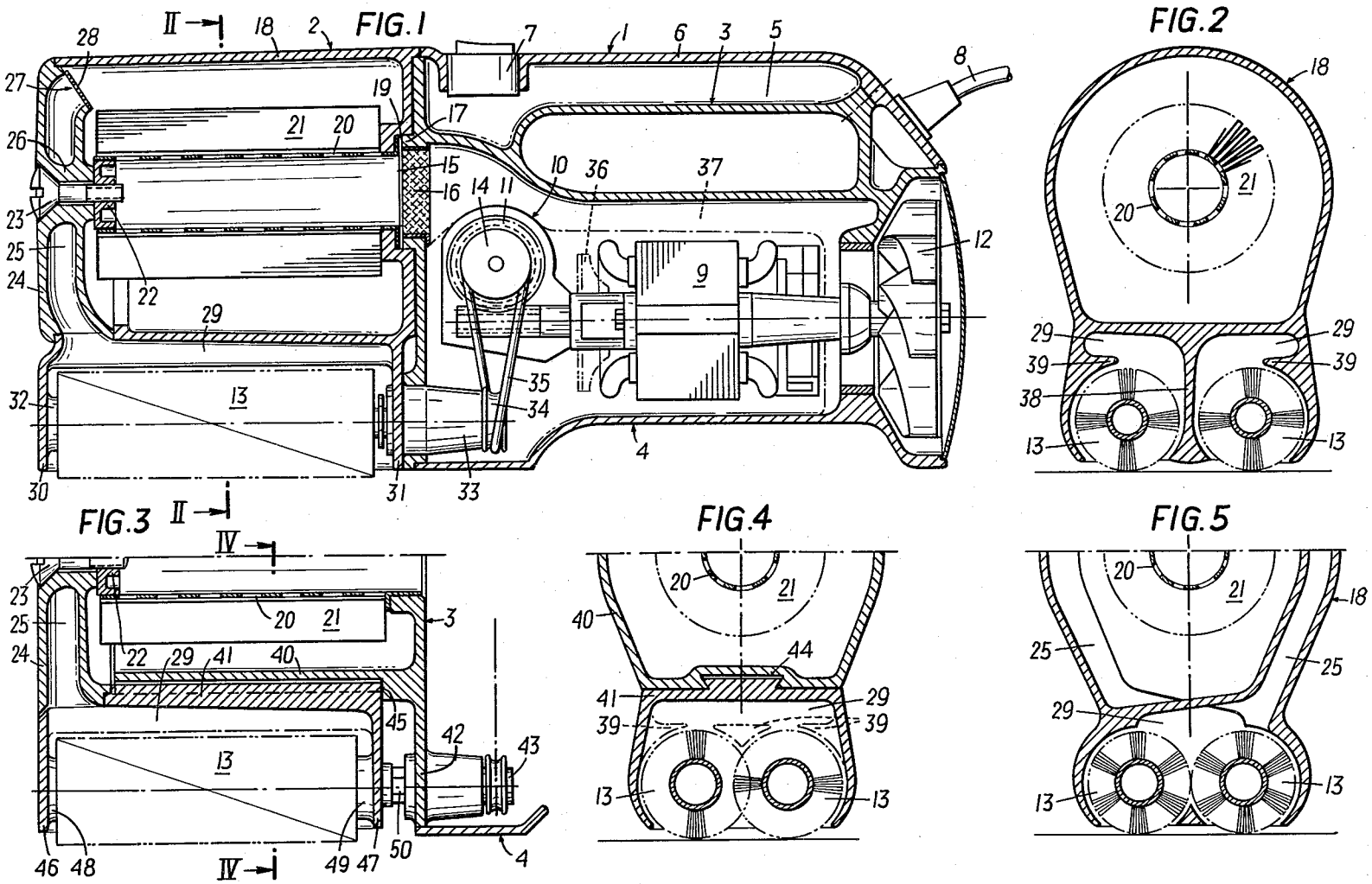
FIG. 1 shows a longitudinal section of the portable brush vacuum cleaner according to the present invention.
FIG. 2 shows a cross-section on the line II—II in FIG. 1.
FIG. 3 is a longitudinal section through an alternate embodiment of the brush housing.
FIG. 4 is a cross-section view thaken on the line IV—IV in FIG. 3.
FIG. 5 shows a cross-section taken through an alternate mode of the brush housing.

The portable brush vacuum cleaner shown in FIGS. 1 and 2 includes the basic appliance 1 provided with a motor 9 and suction fan 12. A housing 2 is formed to function as a dust-collector and is attached to the basic appliance 1. The basic appliance 1 includes a casing which is divided into two halves 3 and 4 along the transverse axis of motor 9 and has a handle 5 closed by a lid 6. On top of the handle near a thumb-piece is an On/Off switch 7 and at the back of the handle is a connection for an electric lead 8. to the handle 5 and on casing part 3 the motor 9 is fastened with, for example, screws or rubber bolts. The motor is connected at one end to worm gearing 10. Bearing collars for the bearings of the worm gear 11 are connected with the flange of the motor 9, while at the opposite end of motor 9 two brushes 13 are each connected to a separate pulley 14 provided outside the bearings of the worm gear 11 on each side of the worm gear 11. Each pulley 14 is further connected to the shaft of the worm gear.

On the front of the casing part 3, at about the height of the upper edge of the worm gear 10, which is provided with a dust proof casing, on inlet 15 is provided into which an additional filter 16 can be disposed to prevent the motor compartment from becoming dirty when the dust-collector 18 is removed. A projection 17 formed on the first half 3 of the casing serves as a centering surface. A dust-collector 18 abuts projection 17. The flange of dust-collector 18 is attached to the casing part 3 the casing part 3 with clips, screws, hinged handles (not illustrated). In a side portion of the dust-collector 18 facing the motor is an attachment section or recessed shoulder portion 19 into which a slotted or perforated tube 20 is pressed. A roller-filter 21 can be pushed onto the perforated tube 20.

The tube 20 has a closed end and a threaded part into which a countersunk screw can be fitted, thus making it possible to remove the front cover 24 to empty the dust-collector 18. In cover 24 there is formed a rising suction channel 25 which extends around the base 26 of the screw 23 and emerges through the outlet 27 further up in the dust-collector 18. To prevent an unintentional emptying of the dust, this outlet 27 is fitted with a flap valve 28.

Above and over the whole length of the brushes 13 there is the additional suction space or chamber 29 which opens out into suction channel 25. The suction space 29 opens out into the front face of the dust-collector 18 in the removable cover 24, into which the elevated suction channel 25 emerges. For a better dispersal the additional suction space 29 has been slightly elevated towards the opening of suction channel 25. The two brushes 13 are mounted so as to be able to rotate in the bearings 32 and 33 on both the facing walls 30 and 31 which close the additional suction channel 25. Bearings 33 are each fitted with a pulley 34. For each of them a driving belt 35 is provided for power transmission. This driving belt enables the two brushes to be driven in opposite directions towards or away from each other.

After fastening the dust-collector 18 equipped with the brushes 13 and the pulley 34 to the casing part 3, the driving belts 35 can be connected to the pulley 34 and the casing part 3 can be fixed to casing part 4 with screws, etc. The ventilation of the motor 9 can be carried out in the traditional manner, in that air sucked is circulated through the motor compartment. It is also possible to provide a special fan propeller 36 and thus blow the sucked-in air through a separate channel 37 in the motor casing towards the suction impeller 12, or even in the opposite direction, e.g., via the hollow handle to the motor compartment from where the air could escape through air vents in the motor casing.

FIG. 2 shows the use of two brushes 13 being driven in opposite directions towards each other. The cross-piece 38 is connected to the dust-collector 18 and is placed between the two brushes and extends at least down to the middle of the horizontal axis of the brushes. The suction space 29 can either open out into one or separate suction channels 25. Just above the brushes 13, or adjacent their downward rotating edges, baffle elements 39 are provided, attached in each case to dust-collector 18 and extend to about the middle of its vertical axis. This partly seals off the additional suction space 29 along the bottom portion thereof. It is also possible, however, to provide for one additional suction space only, and to dispose a crosspiece lengthways under the point of intersection of the generating lines of the two brushes. This hinders the sucking in of relatively large loose objects, as illustrated in FIG. 5.

FIGS. 3 and 4 illustrate a further form of the invention. Here the dust-collector 2 is divided and includes a modified dust-collector 40 and a brush housing 41 slotted into it. The dust-collector 40 in this example is formed homogeneously with the casing part 3 which at its lower end is equipped with projection 42 to support the bearings for the driving shaft 43. The base of the dust-collector includes a dovetail groove 44, into which the brush housing 41, which has a corresponding guiding groove formed therein, is pushed until it reaches the shoulder portion 45 on casing part 3 intended for locating brush housing 41 thereagainst. The brush housing 41 is fixed in its axial position by front cover 24 which can be put on the facing of the dust-collector 40. Above the brushes 13 there is disposed the brush housing 31 with the additional suction space 29 which, as described above, opens out into the suction channel 25 of the lid 24.

The brush housing 41 is equipped on both sides with facing walls 46 and 47 which shut off the additional suction space 29. Walls 46 and 47 are fitted with bearings 48 and 49 for mounting the brushes 13. The brushes 13 are joined on the motor side by hexagonal lynchpins 50, so that after the brush housing 41 has been pushed in, the lynchpins 50 are connected for power transmission with input shaft 43. Instead of the lynchpins, dog clutches or sliding clutches, for instance, are also suitable.

FIG. 4 illustrates the development of the additional suction space 29 in which it opens out into a suction channel 25 on the front of the dust-collector. By providing an additional baffle element 39 above each brush, the additional suction space 29 is partly closed at the bottom, as indicated in dotted lines, to demonstrate the possibility of having the brushes move in opposite directions away from each other as well as towards each other—the latter being preferable.

FIG. 5 illustrates another development of the invention. In this embodiment the additional suction space 29 is joined at the opening in each case with one suction channel 25 which rises at both sides of the dust-collector 18 and extends over the roller-filter 21. The suction channels 25 are best divided along the length of the brushes 13 so that a cross-section of the intake is considerably greater than that of the suction fan, whereby the division is such that inlets on the right and left are not opposite each other. When the brushes 13 are turning outwardly, an additional baffle element 39, similar to that in FIG. 4, can be placed between the brushes and above them. The dust-collector 18 or 40 can also be provided with a front cover 24, in this case without the suction channel 25, and this can for instance be circular to make the use of a bayonet joint possible. Possible construction variations shown in the other examples, e.g. the arrangement of a cross-piece 38 between the brushes 13, or the division of dust collector housing 2, could also be used in this particular development.

Instead of a worm gearing 10, variable-speed spur gearing can also be used to drive the brush or brushes 13. Instead of the pulleys 34 driven by driving belts 35 to move the brushes 13, a pair of bevel gears can be used in each case; in this case the worm gear would have to be disposed under the auger shaft. The basic appliance 1 can also be employed for other uses which require this motor.

Obviously, numerous modifications and variations of the present invention are possible in light of the above teachings. It is therefore to be understood that within the scope of the appended claims, the invention may be practiced otherwise than as specifically described therein.

I claim:

1. A handheld vacuum for removing dust from an object comprising:

a casing;

an electric motor disposed within said casing;

suction means connected to said electric motor for removing said dust;

gear reduction means connected to said electric motor;

at least one cylindrical cleaning brush connected to and driven via said gear reduction means;

a dust collector provided on said casing;

fluid inlet means formed in said dust collector;

fluid outlet means formed in said dust collector communicating with said suction means;

at least one suction channel fluidly communicating with said fluid inlet means;

a brush housing separate from said dust container and disposed adjacent said at least one cylindrical cleaning brush and forming a suction chamber fluidly communicating with said at least one suction channel; and baffle means operatively associated with said brush housing and longitudinally disposed adjacent an upper portion of said at least one cylindrical cleaning brush, said baffle means defining a surface portion of said suction chamber for preventing said dust from returning to said object.

2. The vacuum of claim 1 wherein said at least one suction channel comprises a first and a second suction channels.

3. The vacuum of claim 1 wherein said at least one cylindrical cleaning brush comprises a longitudinal axis and wherein said suction chamber comprises first and second end portions axially spaced adjacent said longitudinal axis of said at least one cylindrical cleaning brush and wherein said at least one suction channel is vertically disposed with respect to said longitudinal axis of said at least one cylindrical cleaning brush such that said at least one suction channel fluidly joins said suction chamber at said first end portion thereof.

4. The vacuum of claim 3 further comprising a detachable cover member connected to said dust collector adjacent said first axial end portion of said at least one cylindrical cleaning brush and wherein said at least one suction channel is provided within said detachable cover member.

5. The vacuum of claim 4 wherein said dust collector and said brush housing each further comprises connecting means for mutual detachable engagement therebetween.

6. The vacuum of claim 5 wherein said connecting means comprises means for forming a dovetail joint.

7. The vacuum of claim 5 wherein said at least one cylindrical cleaning brush is secured to and stored within said brush housing, and wherein said vacuum further comprises:

a drive shaft coupled to said gear reduction means; and a brush shaft provided on said at least one cylindrical cleaning brush having engaging means for coupling with said drive shaft such that mutual engagement of said connecting means couples said brush shaft with said drive shaft via said engaging means.

8. The vacuum of claim 1 wherein said at least one cylindrical cleaning brush further comprises a first and a second cylindrical cleaning brush, said first and second cylindrical cleaning brushes being disposed in a mutually parallel relationship and wherein said baffle means is disposed adjacent an upper portion and a side portion of each of said first and second cylindrical cleaning brushes.

9. The vacuum of claim 8 further comprising a cross piece disposed between said first and second cylindrical cleaning brushes and extending from an upper portion of said brush housing to a lower portion of said brush housing so as to partition said suction chamber between said first and second cylindrical cleaning brushes.

* * * * *